US008261714B2

(12) United States Patent
Nummerdor

(10) Patent No.: US 8,261,714 B2
(45) **Date of Patent: *Sep. 11, 2012**

(54) RF MONOBLOCK FILTER WITH OUTWARDLY EXTENDING WALL TO DEFINE A CAVITY SURROUNDING A TOP SURFACE OF THE FILTER

(75) Inventor: Jeffrey J. Nummerdor, Rio Rancho, NM (US)

(73) Assignee: CTS Corporation, Elkhart, IN (US)

( * ) Notice: Subject to any disclaimer, the term of this patent is extended or adjusted under 35 U.S.C. 154(b) by 13 days.

This patent is subject to a terminal disclaimer.

(21) Appl. No.: 12/316,233

(22) Filed: Dec. 9, 2008

(65) Prior Publication Data

US 2009/0146761 A1 Jun. 11, 2009

Related U.S. Application Data

(60) Provisional application No. 61/005,973, filed on Dec. 10, 2007.

(51) Int. Cl.
*H01P 1/205* (2006.01)

(52) U.S. Cl. ..... 123/202; 333/206

(58) Field of Classification Search ..... 333/202, 333/206, 134

See application file for complete search history.

(56) References Cited

U.S. PATENT DOCUMENTS

| | | | |
|---|---|---|---|
| 4,737,746 | A | 4/1988 | Ueno |
| 4,837,534 | A | 6/1989 | Van Horn |
| 4,937,542 | A | 6/1990 | Nakatuka |
| 5,177,458 | A | 1/1993 | Newell et al. |
| 5,512,866 | A | 4/1996 | Vangala et al. |
| 5,602,518 | A | 2/1997 | Clifford, Jr. et al. |
| 5,959,511 | A | 9/1999 | Pasco et al. |
| 6,023,207 | A | 2/2000 | Ito et al. |
| 6,052,040 | A | 4/2000 | Hino |

(Continued)

FOREIGN PATENT DOCUMENTS

| | | |
|---|---|---|
| EP | 62 252202 | 11/1987 |

(Continued)

OTHER PUBLICATIONS

Kruck, Peter, PCT International Search Report mailed Apr. 23, 2009 re: International Application No. PCT/US2008/013534 filed Dec. 9, 2008.

(Continued)

*Primary Examiner* — Benny Lee

(74) *Attorney, Agent, or Firm* — Daniel J. Deneufbourg; Mark P. Bourgeois

(57) ABSTRACT

An electrical signal filter defined by a block of dielectric material with a top surface, a bottom surface, side surfaces, and through-holes extending between the top and bottom surfaces. In one embodiment, a plurality of walls extend outwardly from the top surface to define a peripheral rim and filter cavity. A pattern of metallized and unmetallized areas is defined on selected surfaces of the block including an area of metallization that covers at least a portion of the top surface and at least one of the walls to define at least one input/output electrode on the wall. In one embodiment, a pair of input/output electrodes are formed on a pair of posts defined on one of the walls and the filter is adapted for mounting to a printed circuit board with the rim of the walls against the board and the posts coupled to respective input and output pads on the board.

18 Claims, 7 Drawing Sheets

U.S. PATENT DOCUMENTS

| | | | | |
|---|---|---|---|---|
| 6,204,738 | B1 | 3/2001 | Toda et al. | |
| 6,236,288 | B1 * | 5/2001 | Tsujiguchi | 333/134 |
| 6,498,542 | B1 | 12/2002 | Kuroda et al. | |
| 6,737,943 | B2 | 5/2004 | Takubo et al. | |
| 6,765,457 | B2 | 7/2004 | Tada et al. | |
| 2001/0052832 | A1 | 12/2001 | Gotoh et al. | |
| 2002/0109562 | A1 | 8/2002 | Tsukamoto et al. | |

FOREIGN PATENT DOCUMENTS

| | | |
|---|---|---|
| EP | 03 239001 | 10/1991 |
| EP | 0 865 094 | 9/1998 |
| EP | 0 999 606 | 5/2000 |
| JP | 62 252202 | 11/1987 |
| JP | 03 239001 | 10/1991 |
| JP | 406216607 | 8/1994 |
| JP | 2005 191983 | 7/2005 |

OTHER PUBLICATIONS

Kruck, Peter, PCT Written Opinion of the International Searching Authority mailed Apr. 23, 2009 re: International Application No. PCT/US2008/013534 filed Dec. 9, 2008.

* cited by examiner

RF MONOBLOCK FILTER WITH OUTWARDLY EXTENDING WALL TO DEFINE A CAVITY SURROUNDING A TOP SURFACE OF THE FILTER

CROSS-REFERENCE TO RELATED AND CO-PENDING APPLICATIONS

This application claims the benefit of the filing date of U.S. Provisional Patent Application Ser. No. 61/005,973 filed on Dec. 10, 2007 and entitled, "RF Monoblock Filter with Recessed Top Pattern and Cavity Providing Improved Attenuation", the entire disclosure of which is explicitly incorporated herein by reference as are all references cited therein.

TECHNICAL FIELD

This invention relates to dielectric block filters for radio-frequency signals and, in particular, to monoblock passband filters.

BACKGROUND

Ceramic block filters offer several advantages over lumped component filters. The blocks are relatively easy to manufacture, rugged, and relatively compact. In the basic ceramic block filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the resonator through-holes.

One of the two opposing sides containing through-hole openings is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices and longer battery life. Combined, these trends place difficult constraints on the design of wireless components such as filters. Filter designers may not simply add more space-taking resonators or allow greater insertion loss in order to provide improved signal rejection.

A specific challenge in RF filter design is providing sufficient attenuation (or suppression) of signals that are outside the target passband at frequencies which are integer multiples of the frequencies within the passband. The label applied to such integer-multiple frequencies of the passband is a "harmonic." Providing sufficient signal attenuation at harmonic frequencies has been a persistent challenge.

SUMMARY

The present invention is directed to an electrical signal filter for RF frequencies which, in one embodiment, comprises a block of dielectric material with a top surface, a bottom surface and side surfaces. The block defines one or more through-holes extending between an opening in the top surface and an opening in the bottom surface. One or more walls or posts extend outwardly and upwardly away from the peripheral edges of the top surface to define a top filter cavity and a peripheral outer rim.

A pattern of metallized and unmetallized areas is defined on the block. The pattern includes a recessed area of metallization that covers at least a portion of the top surface and areas which cover the bottom and side surfaces, the through-holes, and at least a portion of the walls or posts.

Resonator pads are defined adjacent the through-hole openings on the top surface and are connected to the contiguous area of metallization. An input electrode which is defined on the top surface extends onto one of the walls or posts. An output electrode which is also defined on the top surface also extends onto the one or another of the walls or posts. A contiguous unmetallized area substantially surrounds the pad, the input electrode, the output electrode, and the wall(s) or posts onto which the input and output electrodes extend.

In one embodiment, the filter is adapted to be mounted to the top of a printed circuit board in a relationship wherein the rim of the walls of the filter is seated against the top surface and the input and output electrodes formed on the walls or posts are in contact with respective input and output pads on the board.

There are other advantages and features of this invention, which will be more readily apparent from the following detailed description of the embodiments of the invention, the drawings, and the appended claims.

BRIEF DESCRIPTION OF THE FIGURES

In the accompanying drawings that form part of the specification, and in which like numerals are employed to designate like parts throughout the same.

The figures are not drawn to scale.

DETAILED DESCRIPTION OF THE PREFERRED EMBODIMENTS

While this invention is susceptible to embodiment in many different forms, this specification and the accompanying drawings disclose two embodiments of the filter in accordance with the present invention. The invention is, of course, not intended to be limited to the embodiments so described, however. The scope of the invention is identified in the appended claims.

FIGS. 1-4 depict a radio frequency (RF) filter 10 in accordance with the present invention which comprises a generally elongate, parallelepiped or box-shaped rigid block or core 12 comprised of a ceramic dielectric material having a desired dielectric constant. In one embodiment, the dielectric material can be a barium or neodymium ceramic with a dielectric constant of about 37 or above.

Figure 1:
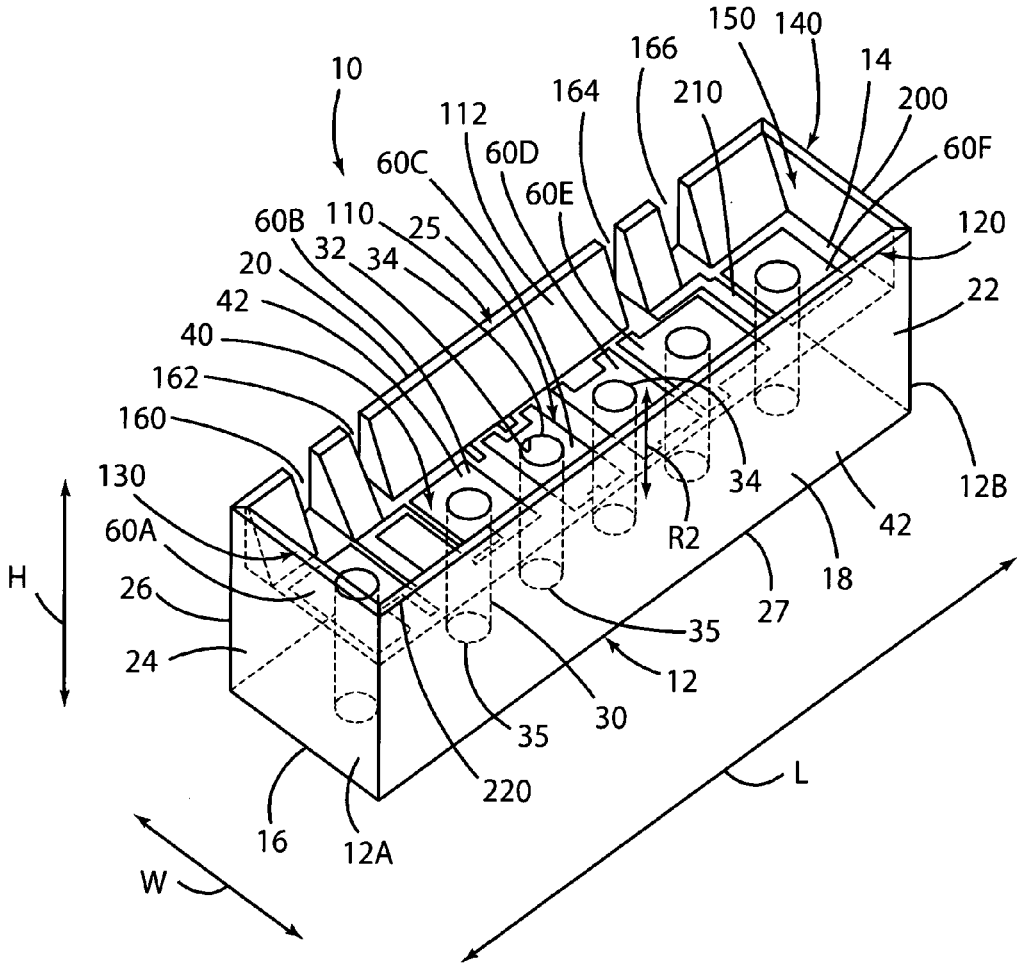
FIG. 1 is an enlarged top side perspective (or more precisely an isometric) view of a filter according to the present invention showing the details of the surface-layer pattern of metallized and unmetallized areas and showing the hidden features.
Figure 2:
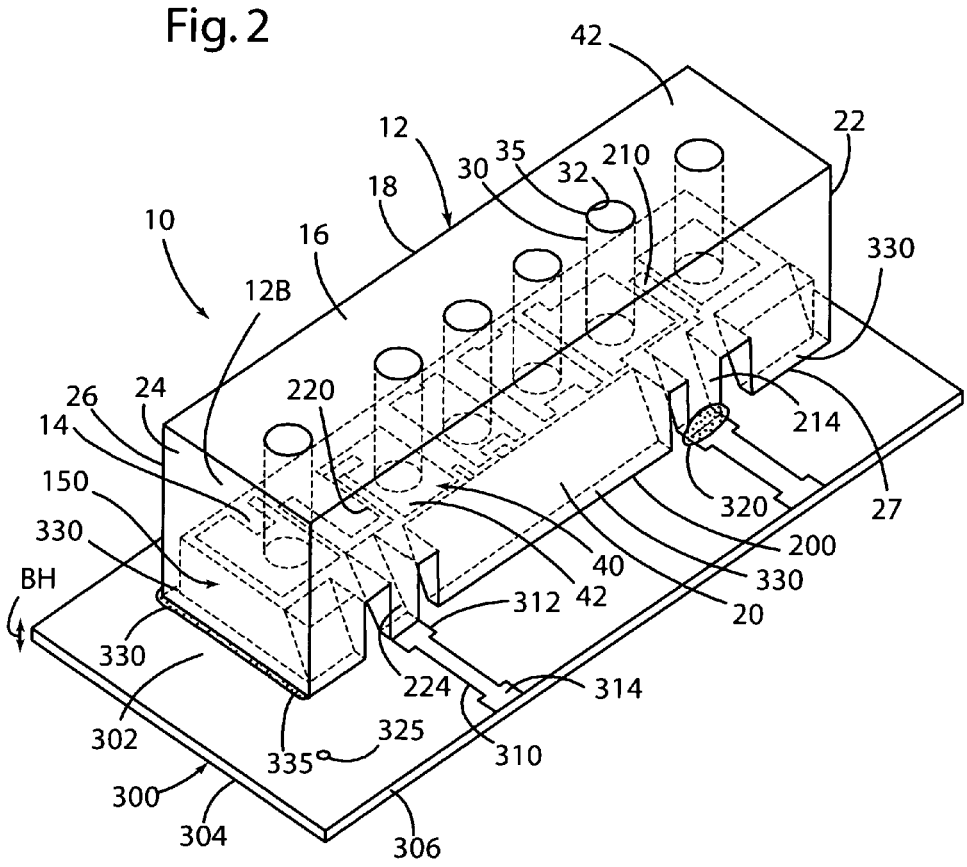
FIG. 2 is an enlarged bottom side perspective view of the filter shown in FIG. 1 mounted to a circuit board.

Core 12 has opposed ends 12A (FIG. 1) and 12B (FIG. 2). Core 12 defines an outer surface with six generally rectangular sides: a top side or top surface 14 (FIGS. 1, 3, and 4); a bottom side or bottom surface 16 (FIGS. 1, 3, and 4) that is parallel to and diametrically opposed from top surface 14; a first side or side surface 18 (FIGS. 1, 3, and 4); a second side or side surface 20 (FIGS. 2, 3, and 4) that is parallel to and diametrically opposed from side surface 18; a third side or end surface 22; and a fourth side or end surface 24 that is parallel to and diametrically opposed from end surface 22. Core 12 and the respective side surfaces thereof additionally define a plurality of vertical peripheral core edges 26 and a plurality of horizontal bottom peripheral edges 27.

Core 12 additionally defines four generally planar walls 110, 120, 130 and 140 (FIGS. 1, 3, and 4) that extend upwardly and outwardly away from the respective four outer peripheral edges of the top surface 14 thereof. Walls 110, 120, 130, 140 and top surface 14 together define a cavity 150 (FIGS. 1, 3, and 4) at the top of the filter 10. Walls 110, 120, 130, 140 further together define a peripheral top rim 200 (FIGS. 1, 3, and 4) at the top of the walls.

Walls 110 and 120 are parallel and diametrically opposed to each other. Walls 130 and 140 are parallel and diametrically opposed to each other.

Figure 3:
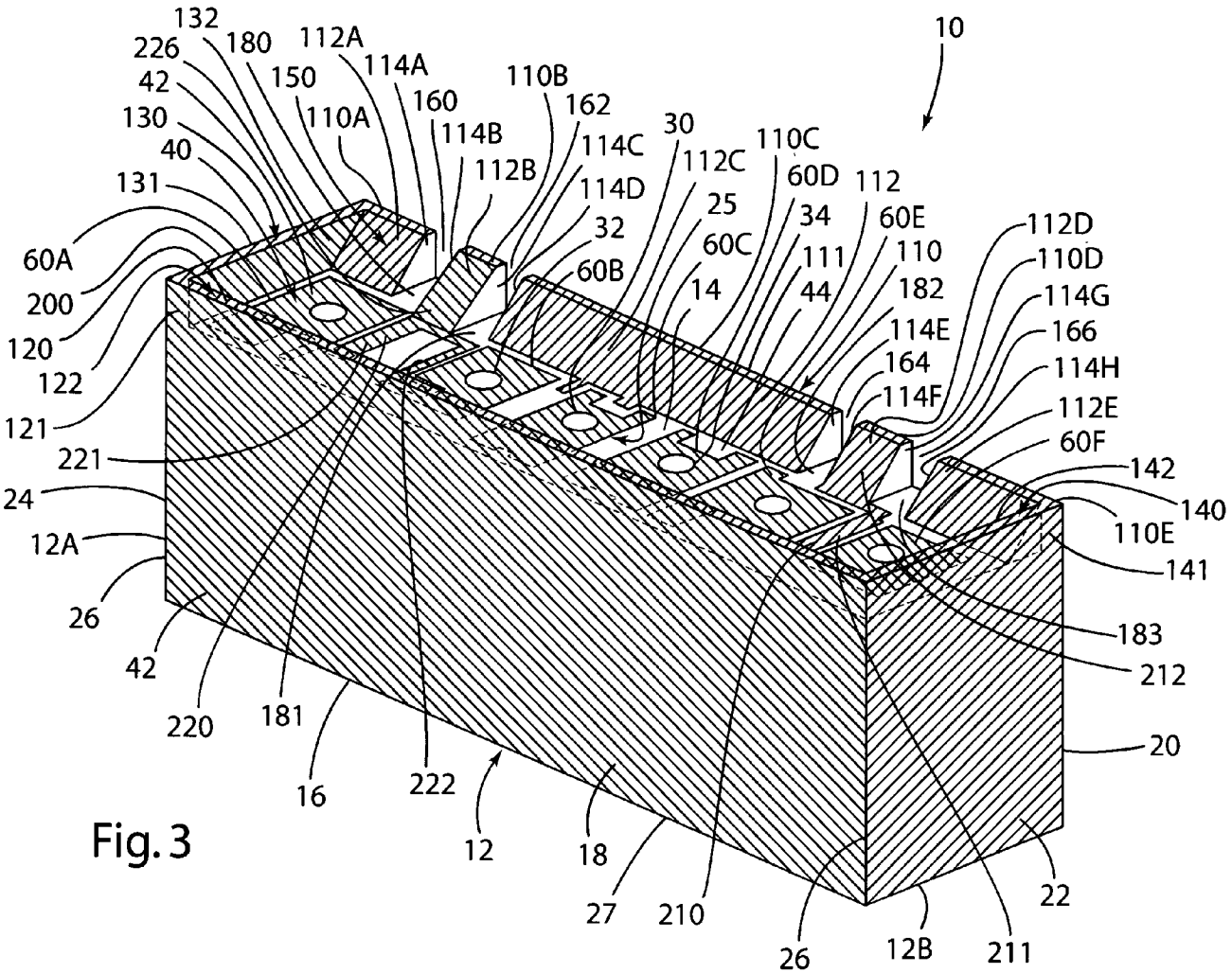
FIG. 3 is another enlarged top side perspective view of the filter shown in FIG. 1.

Wall 110 (FIGS. 1, 3, and 4) has an outer surface 111 (FIGS. 3 and 4) and an inner surface 112 (FIGS. 1 and 3). Outer surface 111 is co-extensive and co-planar with side surface 20 while inner surface 112 slopes or angles outwardly and downwardly away from the rim 200 into top surface 14 and in the direction of opposed wall 120 so as to define a surface which is sloped at approximately a 45 degree angle relative to both the top surface 14 and the wall 110. Other slope angles may be used. Walls 120, 130 and 140 all define generally vertical outer walls generally co-planar with the respective core side surfaces and generally vertical inner walls that are generally substantially in a relationship that is normal to the plane defined by top surface 14.

Wall 110 additionally defines a plurality of generally parallel and spaced-apart slots 160, 162, 164 and 166 (FIGS. 1, 3, and 4) that extend through wall 110 in an orientation generally normal to top surface 14.

An end wall portion 110A (FIG. 3) is defined between the wall 130 and slot 160. A wall portion or post or finger 110B (FIGS. 3 and 4) is defined between spaced-apart slots 160 and 162 and toward end 12A. A wall portion 110C (FIG. 3) is defined between slots 162 and 164. A wall portion or post or finger 110D (FIGS. 3 and 4) is defined between slots 164 and 166 toward end 12B. Post 110D is diametrically opposed to post 110B and is defined in an end portion of wall 110 adjacent the wall 140. An end wall portion 110E (FIG. 3) is defined between wall 140 and slot 166.

Inner surface 112 is further separated into several portions including inner angled or sloped surface portions 112A, 112B, 112C, 112D and 112E (FIG. 3). Inner surface portion 112A is located on wall portion 110A. Inner surface portion 112B is located on wall portion or post 110B. Inner surface portion 112C is located on wall portion 110C. Inner surface portion 112D is located on wall portion or post 110D. Inner surface portion 112E is located on wall portion 110E.

Wall portions 110A, 110B, 110C, 110D, and 110E further define generally triangularly-shaped side walls. Specifically, wall portion 110A defines a side wall 114A (Fiq. 3) adjacent to slot 160. Post 1108 defines a side wall 1148 (FIG. 3) adjacent to slot 160 and an opposed side wall 114C (Fiq. 3) adjacent to slot 162. Wall portion 110C defines a side wall 114D (FIG. 3) adjacent to slot 162 and an opposed side wall 114E adjacent to slot 164. Post 110D defines a side wall 114F (FIG. 3) adjacent to slot 164 and a side wall 114G (Fiq. 3) adjacent to slot 166. Wall portion 110E defines a side wall 114H (FIG. 3) adjacent to slot 166.

Figure 4:
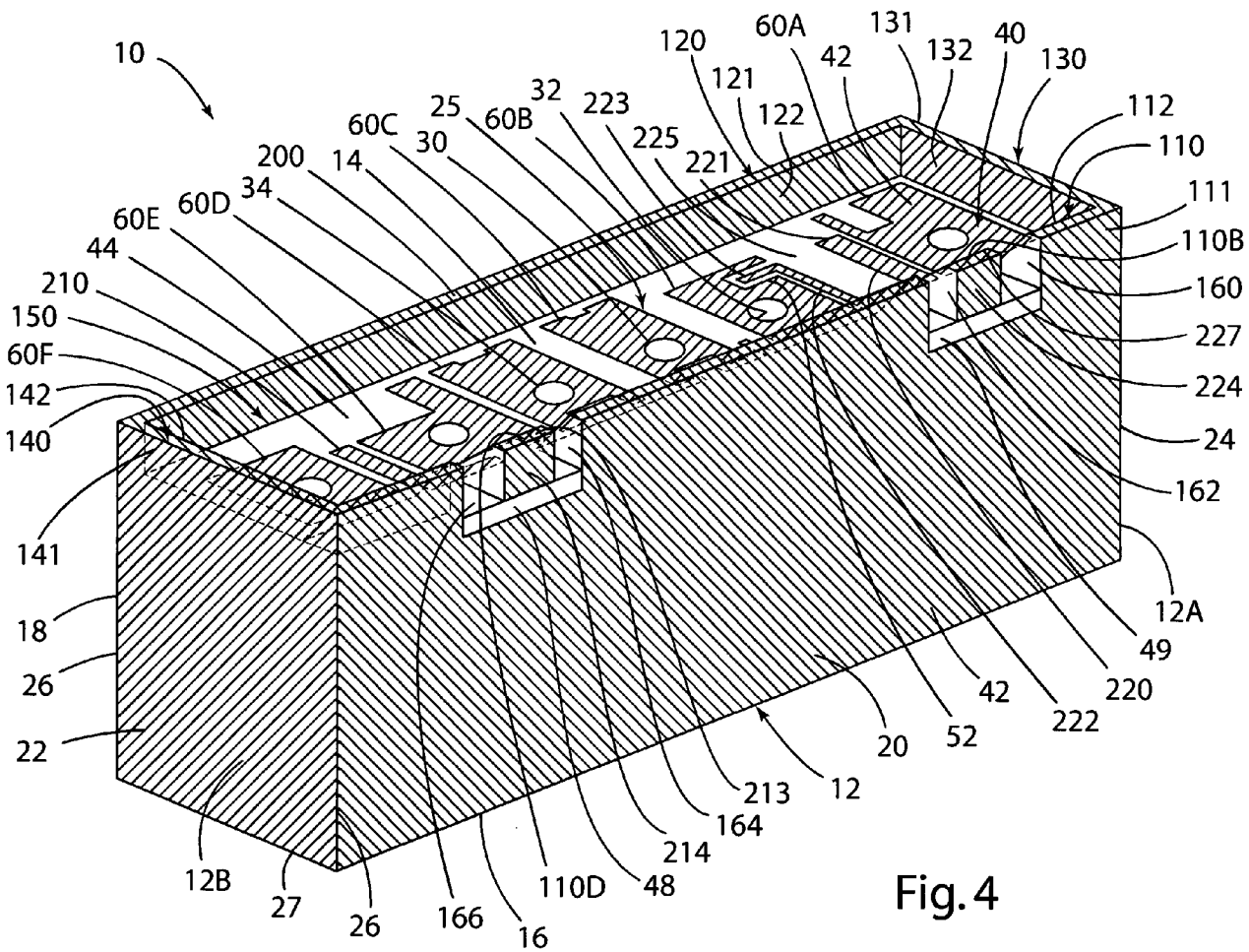
FIG. 4 is an additional enlarged top side perspective view of the filter shown in FIG. 1.

Wall 120 has an outer surface 121 (FIG. 4) and an inner surface 122 (FIGS. 3 and 4). Outer surface 121 is co-extensive and co-planar with side 18 and inner surface 122 is perpendicular to top surface 14.

Wall 130 has an outer surface 131 (FIGS. 3 and 4) and an inner surface 132 (FIGS. 3 and 4). Outer surface 131 is co-extensive and co-planar with side 24 and inner surface 132 is perpendicular to top surface 14.

Wall 140 has an outer surface 141 (FIGS. 3 and 4) and an inner surface 142 (FIGS. 3 and 4). Outer surface 141 is co-extensive and co-planar with side 22 and inner surface 142 is perpendicular to top surface 14.

Top surface 14 can have several portions that are located and extend between the slots of wall 110. Top surface portion 180 (FIG. 3) forms the base of slot 160 and is located between wall portions 114A and 114B. Top surface portion 181 (FIG. 3) forms the base of slot 162 and is located between wall portions 114C and 114D. Top surface portion 182 (FIG. 3) forms the base of slot 164 and is located between wall portions 114E and 114F. Top surface portion 183 (FIG. 3) forms the base of slot 166 and is located between wall portions 114G and 114H.

The filter 10 has a plurality of resonators 25 (FIGS. 1, 3, and 4) defined in part by a plurality of metallized through-holes. Specifically, resonators 25 take the form of through-holes 30 (FIG. 2) which are defined in dielectric core 12. Through-holes 30 extend from and terminate in openings 34 (FIGS. 3 and 4) in top surface 14 and openings 35 (FIG. 2) in bottom surface 16. Through-holes 30 are aligned in a spaced-apart, co-linear relationship in block 12 such that through-holes 30 are equal distances from sides 18 and 20. Each of through-holes 30 is defined by an inner cylindrical metallized side-wall surface 32 (FIGS. 1, 2, and 4).

Top surface 14 of core 12 additionally defines a surface-layer recessed pattern 40 (FIGS. 1, 3, and 4) of electrically conductive metallized and insulative unmetallized areas or patterns. Pattern 40 is defined on the top surface 14 of core 12 and thus defines a recessed filter pattern by virtue of its recessed location at the base of cavity 150 in spaced relationship from and with the top rim 200 of walls 110, 120, 130, and 140.

The metallized areas are preferably a surface layer of conductive silver-containing material. Recessed pattern 40 also defines a wide area or pattern of metallization 42 (FIGS. 1, 3, and 4) that covers bottom surface 16 and side surfaces 18, 22 and 24. Wide area of metallization 42 also covers a portion of top surface 14 and side surface 20 and side walls 32 of through-holes 30. Metallized area 42 extends contiguously from within resonator through-holes 30 towards both top surface 14 and bottom surface 16. Metallization area 42 may also be labeled a ground electrode. Area 42 serves to absorb or prevent transmission of off-band signals. A more detailed description of recessed pattern 40 on top surface 14 follows.

For example, a portion of metallized area 42 is present in the form of resonator pads 60A, 60B, 60C, 60D, 60E and 60F (FIGS. 1, 3, and 4) which surround respective through-hole openings 34 defined on top surface 14. Resonator pads 60A-60F are contiguous or connected with metallization area 42 that extends through the respective inner surfaces 32 of through-holes 30. Resonator pads 60A-60F at least partially surround the respective openings 34 of through-holes 30. Resonator pads 60A-60F are shaped to have predetermined capacitive couplings to adjacent resonators and other areas of surface-layer metallization.

An unmetallized area or pattern 44 (FIGS. 3 and 4) extends over portions of top surface 14 and portions of side surface 20. Unmetallized area 44 surrounds all of the metallized resonator pads (60A-60F).

Unmetallized area 44 extends onto top surface slot portions 180, 181, 182 and 183 (FIG. 3). Unmetallized area 44 also extends onto side wall slot portions 114A, 114B, 114C, 114D, 114E, 114F, 114G and 114H (FIG. 3). Side wall slot portions 114A and 114B define the opposed side walls of post 110B. Side wall slot portions 114F and 114G define the opposed side walls of post 110D.

Unmetallized area 44 also defines an unmetallized area 49 (FIG. 4) which extends onto a portion of side surface 20 located below post 110B and slots 160 and 162 in a generally rectangular shape. A similar unmetallized area 48 (FIG. 4) extends onto a portion of side surface 20 located below post 110D and slots 164 and 166 in a generally rectangular shape. Unmetallized areas 44, 48 and 49 are co-extensive or joined or coupled with each other in an electrically non-conducting relationship.

Surface-layer pattern 40 additionally defines a pair of isolated conductive metallized areas for input and output connections to filter 10. An input connection area or electrode 210 (FIGS. 1, 2, 3, and 4) and an output connection area or electrode 220 (FIGS. 1, 2, 3, and 4) are defined on top surface 14 and extend onto a portion of wall 110 and side surface 20 and, more specifically, onto the inner rim and outer portions of respective input and output posts 110D and 1108 where they can serve as surface mounting conductive connection points or pads or contacts as described in more detail below. Electrode 210 is located adjacent and parallel to filter side surface 22 while electrode 220 is located adjacent and parallel to filter side surface 24.

Elongated input connection area of metallization or electrode 210 is located toward end 12B. Input connection area or electrode 210 includes electrode portions 211 and 212 (FIG. 3) and 213 and 214 (FIG. 4). Electrode portion 211 is located between resonator pads 60E and 60F and connects with electrode portion 212 that is located on inner surface portion 112D of post 110D. Electrode portion 212 connects with electrode portion 213 that is located on the top rim portion of post 110D. Electrode portion 213 connects with electrode portion 214 that is located on the outer surface 111 of post 110D. Electrode portion 214 is surrounded on all sides by unmetallized areas 44 and 48 (FIG. 4).

Generally Y-shaped output connection area of metallization or electrode 220 is located toward end 12A. Output connection area or electrode 220 includes electrode portions 221 and 222 (FIG. 3) and 223 and 224 (FIG. 4). Electrode portion or finger 221 is located between resonator pads 60A and 60B, extends in a generally parallel relationship to side 24 and connects with electrode portion 226 (FIG. 3) that is located on inner surface portion 112B of post 110B. Electrode portion 226 connects with electrode portion 227 (FIG. 4) that is located on the top rim portion of post 1108. Electrode portion 227 connects with electrode portion 224 that is located on the outer surface 111 of post 1108. Electrode portion 224 is surrounded on all sides by unmetallized areas 44 and 49 (FIG. 4).

Another electrode portion 222 (FIGS. 3 and 4) is located between resonator pads 60A and 60B and extends in a generally parallel relationship to side 24. Electrode portion 222 is L-shaped and connects with electrode finger 223 (FIG. 4) that extends into a U-shaped unmetallized area 52 that is substantially surrounded by resonator pad 60B. An unmetallized area 225 (FIG. 4) is located between electrode portions 221 and 222.

The recessed surface pattern 40 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 40 also creates inductive coupling between the metallized areas.

With specific reference now to FIG. 2, filter 10 is shown therein mounted to a generally planar rectangular shaped circuit board 300. In one embodiment, circuit board 300 is a printed circuit board having a top or top surface 302, bottom or bottom surface 304 and sides or side surfaces 306. Circuit board 300 has a board height BH that is measured along side 306 between top 302 and bottom 304. Circuit board 300 additionally includes plated through-holes 325 that form an electrical connection between the top 302 and the bottom 304 of the circuit board 300. Several circuit lines 310 and input/output connection pads 312 can be located on top 302 and connected with terminals 314. Circuit lines 310, connection pads 312, and terminals 314 are formed from a metal such as copper and are electrically connected. Terminals 314 connect filter 10 with an external electrical circuit (not shown).

Post 110D and, more specifically, input electrode portion 214 thereof, is attached to one of the connection pads 312 by solder 320. Similarly, post 110B and, more specifically, output electrode portion 224 thereof, is attached to another one of the connection pads 312 by an additional portion of solder (not shown).

Circuit board 300 also has a generally rectangular shaped ground ring or line 330 disposed on top 302 that has the same general shape as rim 200. Ground ring 330 can be formed from copper. Because rim 200 is covered by metallized area 44, rim 200 can be attached to ground ring 330 by solder 335 (only a portion of which is shown in FIG. 2). Solders 320 and 335 would first be screened onto ground ring 330 and connection pads 312 respectively. Next, filter 10 would be placed on top 302 such that input electrode portion 214 and output electrode portion 224 are aligned with connection pads 312.

Circuit board 300 and filter 10 could then be placed in a reflow oven to melt and reflow solders 320 and 335.

The attachment of rim 200 to ground ring 330 forms an electrical path for the grounding of the majority of the outer surface of filter 10.

It is noted that, in FIG. 2, filter 10 is mounted to the board 300 in a top side down relationship wherein the top surface 14 thereof is located opposite, parallel to, and spaced from the top 302 of board 300 and the rim of walls 110, 120, 130, and 140 of filter 10 are soldered to the top 302 of board 300. In this relationship, cavity 150 is partially sealed to define an enclosure defined by the top surface 14, the board surface 302, and the walls 110, 120, 130 and 140 of filter 10. It is further noted that, in this relationship, the through-holes in filter 10 are oriented in a relationship generally normal to the board 300.

As shown in FIG. 1, core 12 has a length L that is measured along side 18 between sides 22 and 24; a width W that is measured along side 24 between sides 18 and 20; a height H that is measured along side 24 between rim 200 and bottom 16; and a resonator length L that is measured between openings 34 and 35.

For higher frequency filters that typically operate above 1.0 GHz, the design of the filter may require that the resonator length (L) (FIG. 1) be less than or shorter than the board height (BH).

In prior art filters that are mounted with either the bottom surface seated flat on the board (top surface facing up) or with one of the side surfaces seated flat on the board (top surface facing sideways), and where the resonator length becomes shorter then the board height, the filter can become unstable at higher frequencies when attached to the circuit board. Additional electromagnetic fields can be created that interfere with and reduce the attenuation of the filter. These additional electromagnetic fields can also reduce the attenuation and sharpness of the attenuation at the filter poles also known as zero points.

The use of filter 10 of the present invention with recessed top surface pattern 40 facing and opposite the board provides improved grounding and off band signal absorption; confines the electromagnetic fields within cavity 150; and prevents external electromagnetic fields outside of cavity 150 from causing noise and interference such that the attenuation and zero points of the filter are improved.

The present invention allows the same footprint (length L and width W) to be used across multiple frequency bands. Prior art filters typically require a size or footprint that would either need to increase or decrease depending upon the desired frequency to be filtered. Filter 10 can have the same overall footprint and still be used at various frequencies.

Another advantage of the present invention is that during solder reflow, filter 10 tends to self align with the ground ring 330 on the circuit board. Filter 10 exhibits improved self alignment because the surface tension of the liquid solder 335 during reflow is distributed equally around rim 200 between ground ring 330 and rim 200 providing self centering of core 12.

The use of a filter 10 defining a cavity 150 and recessed top surface pattern 40 facing and opposite the board 300 also eliminates the need for a separate external metal shield or other shielding as currently used to reduce spurious electromagnetic interference incurred, as the walls 110, 120, 130, and 140 and board 300 provide the shielding. Shielding could still be added, if needed or desired, to filter 10 for a specific application.

The present invention provides improved grounding and confines the electrical fields within cavity 150 to create a filter which exhibits steeper attenuation. Isolation is also improved between resonator pads (60A-60F) thus allowing better harmonic suppression over conventional filters.

Figure 7:
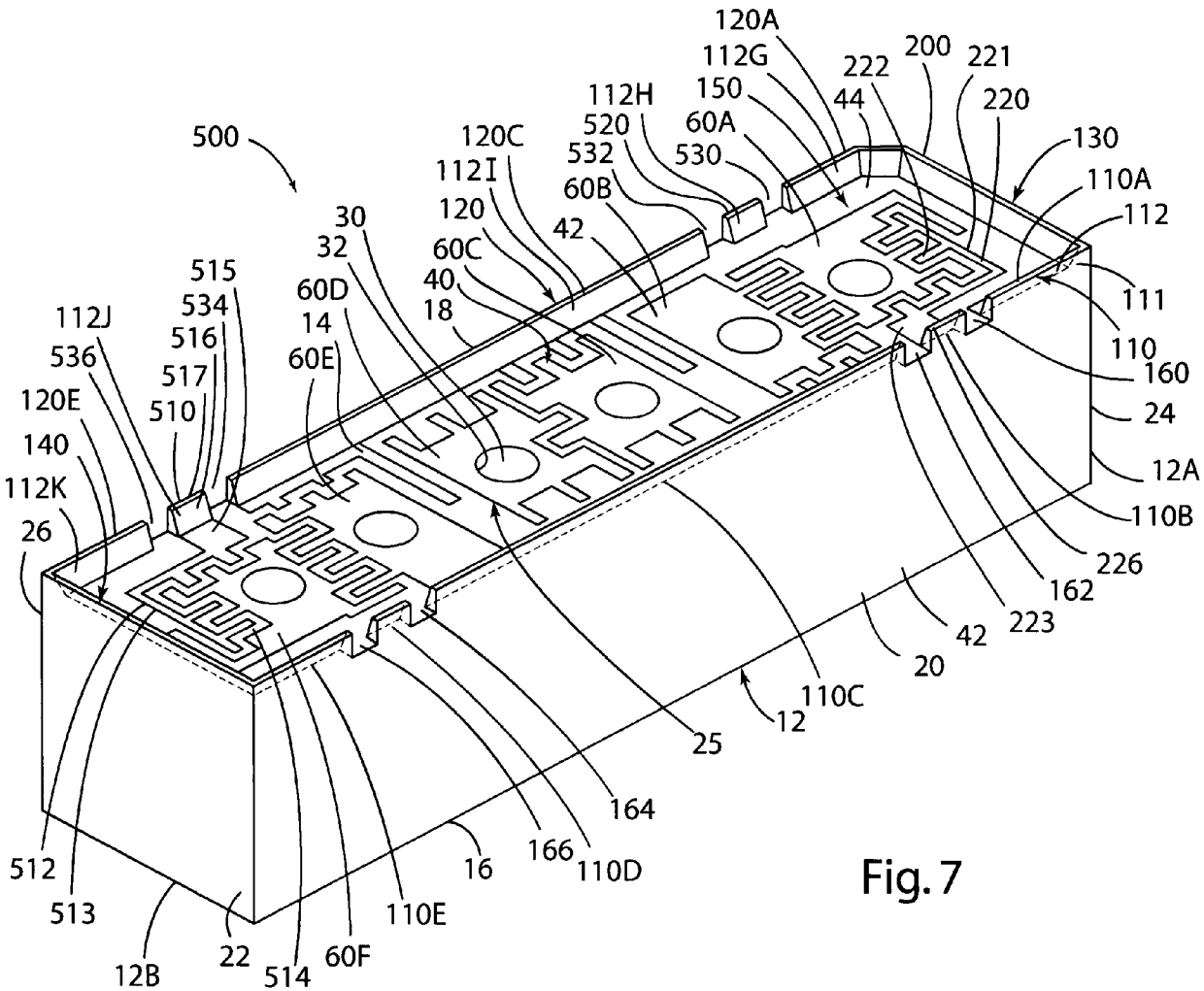
FIG. 7 is a top side perspective view of another embodiment of a filter according to the present invention with input/output connections on both sides of the filter.

This present invention also further allows for the placement of input and output electrodes along any edge or wall of the filter. In one embodiment as shown in FIG. 7 and described in more detail later, and depending upon the particular application, input and output electrodes can be placed on opposite side walls of the filter. In prior art surface mount filters, all of the electrodes are required to be on the same surface plane of the dielectric block.

Recessed pattern 40 still further creates a resonant circuit that includes a capacitance and an inductance in series connected to ground. The shape of pattern 40 determines the overall capacitance and inductance values. The capacitance and inductance values are designed to form a resonant circuit that suppresses the frequency response at frequencies outside the passband including various harmonic frequencies at integer intervals of the passband.

While the embodiment shown in FIGS. 1-4 depicts the cavity 150 and corresponding walls 110, 120, 130, and 140 defining said cavity 150 as being formed adjacent top surface 14, it is noted that cavity 150 and corresponding walls defining the same may be formed on any one or more of any of the other surfaces of core 12 such as the bottom surface 16, side surface 18, side surface 20, side surface 22 or side surface 24.

In other embodiments, cavity 150 may only cover a portion of a surface or side of core 12. For example, cavity 150 may only encompass ten (10%) percent of the area of top surface 14. In another embodiment, multiple cavities 150 may be located on the same side or surface of core 12. For example, three cavities 150 may be defined in top surface 14 by respective additional wall(s).

Moreover, and while the embodiment shown in FIGS. 1-4 depicts core 12 as having several resonators 25, it is noted that cavity 150 may be used on a filter with as few as one resonator 25 and wall(s) surrounding the one resonator.

Electrical Testing

Fabrication details of a filter 10 with cavity 150 and recessed metallization pattern 40 are specified in Table 1 below:

TABLE 1

| | | |
|---|---|---|
| Resonators | 6 | |
| Length | 16.17 | millimeters (mm) |
| Height | 5.1 | millimeters (mm) |
| Width | 4.52 | millimeters (mm) |
| Cavity Depth | .65 | (mm) |
| Rim Width | .25 | (mm) |
| Wall or Rim Height | .65 | (mm) |
| Through-hole Diameter | 1.01 | millimeters (mm) |
| Dielectric Constant | 37.5 | |
| Average Resonator Pad Width | 1.5 | millimeters (mm) |
| Average Resonator Pad Length | 2.3 | millimeters (mm) |
| Slot width | .6 | (mm) |
| Electrode wall width | .76 | (mm) |

While filter 10 was shown having a length L of 16.17 mm., a height H of 5.1 mm., and a width W of 4.52 mm., filter 10 can have dimensions less than 6.17 mm. in length, 5.1 mm. in height and 4.52 mm. in width and still exhibit the desired electrical performance criteria required for filter 10.

A filter 10 with the details summarized in Table 1 above was evaluated using S11 and S12 measurements on a Hewlett Packard network analyzer. Filter performance parameters are listed in TABLE 2, below.

TABLE 2

| | |
|---|---|
| Pass Band | 2110-2170 Megahertz (MHz). |
| Pass Band Insertion Loss | 1.9 dB (at about 2170 MHz) |
| Third (3rd) Harmonic Suppression Improvement | 15 dB |

Figure 5:
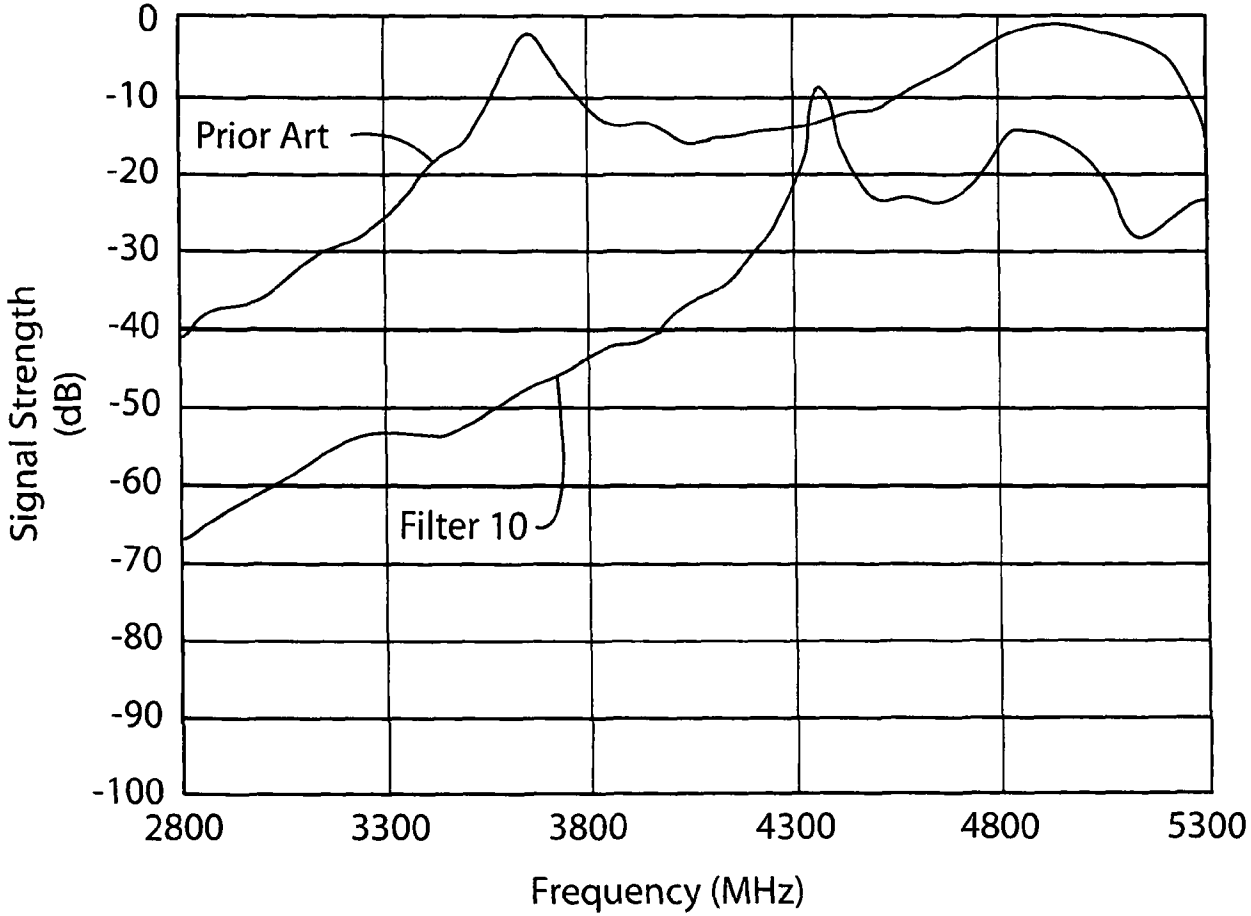
FIG. 5 is a frequency response graph which compares the performance of a prior art filter with the performance of the filter of the present invention.

FIG. 5 is a graph of signal strength (or loss) (dB) versus frequency (MHz) demonstrating the specific measured performance of both a filter 10 in accordance with the present invention defining cavity 150 and recessed metallization pattern 40 and a prior art filter without a recessed pattern. FIG. 5 shows a graph of insertion loss measured between the input and output electrodes for a range of second to third harmonic frequencies. As shown in FIG. 5, filter 10 improves attenuation of third harmonic frequencies above the passband frequencies in comparison to the prior art filter by approximately 15dB.

Figure 6:
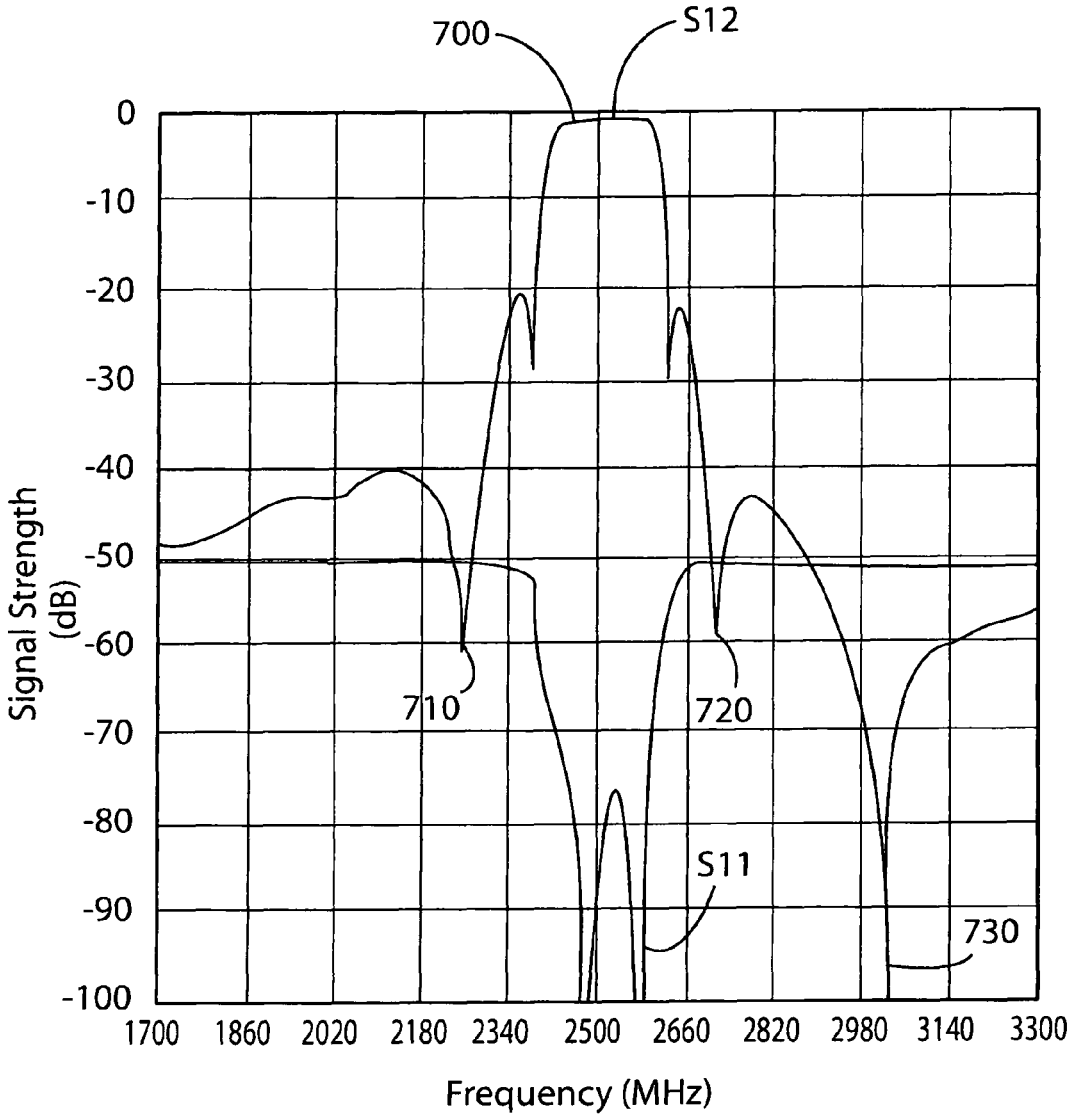
FIG. 6 is another frequency response graph for the filter of FIG. 1.

FIG. 6 is another graph of signal strength (or loss) (dB) versus frequency (MHz) demonstrating the specific measured performance of filter 10 defining cavity 150 and recessed pattern 40. FIG. 6 shows a graph of insertion loss (S12) and return loss (S11) for the frequencies measured between the input and output electrodes. FIG. 6 shows the bandpass frequency 700 and three zero points or poles 710, 720 and 730. Filter 10 provides an increase in the sharpness or steepness of the zero points. At a frequency of 2170 MHz, the insertion loss is approximately 1.9dB.

Although the graphs in FIGS. 5 and 6 illustrate exemplary applications in the range of 1 to 5 Giga-Hertz, an application of the present invention to frequencies in the range of 0.5 to 20 Giga-Hertz is contemplated. The present invention can be applied to an RF signal filter operating at a variety of frequencies. Suitable applications include, but are not limited to, cellular telephones, cellular telephone base stations, and subscriber units. Other possible higher frequency applications include other telecommunication devices such as satellite communications, Global Positioning Satellites (GPS), or other microwave applications.

Alternative Embodiment

Another embodiment of a radio frequency (RF) filter 500 in accordance with the present invention is shown in FIG. 7. Filter 500 is similar to filter 10, and thus the description of filter 10 and the various features and elements thereof is incorporated herein by reference, except that posts 510 and 520 have been added in wall 120. Filter 500 thus has input/output connections or posts on two separate opposed walls 110 and 120 and thus on both opposed sides 18 and 20 of core 12.

In short, filter 500 defines two opposed long side walls 110 and 120 extending upwardly from the core top surface 14 in a relationship generally co-planar with respective opposed filter long side surfaces 18 and 20 and side walls 130 and 140 extending upwardly from the core top surface 14 in a relationship generally co-planar with respective opposed filter short side walls 24 and 22 respectively.

The walls 110, 120, 130, and 140 in combination with the top surface 14 define a cavity 150 in the top of the filter. Wall 110 defines two spaced-apart posts or fingers 110B and 110D while opposed wall 120 defines two spaced-apart posts or fingers 510 and 520. Post 110D is aligned with post 520 and post 110B is aligned with post 510.

Still more specifically, slots 530, 532, 534 and 536 are defined in wall 120. An end wall portion 120A is defined between the wall 130 and slot 160. A wall portion or post or finger 520 is defined between spaced-apart slots 530 and 532. Wall portion 120C is defined between slots 532 and 534. A wall portion or post or finger 510 is defined between slots 534 and 536. An end wall portion 120E is defined between the wall 140 and slot 536.

An end wall portion 110A is defined between the wall 130 and slot 160. A wall portion or post or finger 110B is defined between spaced-apart slots 160 and 162. A post or finger 110B is defined in an end portion of the wall 110 adjacent the wall 130. Wall portion 110C is defined between slots 162 and 164. A wall portion or post or finger 110D is defined between slots 164 and 166. Post 110D is diametrically opposed to post 110B and is defined in an end portion of wall 110 adjacent the wall 140. An end wall portion 110E is defined between the wall 140 and slot 166.

Inner surface 112 is further separated into several portions including inner angled or sloped surface portions 112G, 112H, 112I, 112J and 112K. Inner surface portion 112G is located on wall portion 120A. Inner surface portion 112H is located on wall portion or post 520B. Inner surface portion 112I is located on wall portion 120C. Inner surface portion 112J is located on wall portion or post 510. Inner surface portion 112K is located on wall portion 120E. Inner angled or sloped surface portions 112G, 112H, 112I, 112J and 112K are covered with metallization and are electrically connected with metallization area 42.

Output connection area of metallization or electrode 220 is substantially L-shaped and is located toward end 12A. Output connection area or electrode 220 includes electrode portions of arm 221, fingers 222, pad 223, sloped electrode portion 226 and top portion 227. Electrode portion or fingers 222 extend from arm 221 and are interdigitated with respective fingers of resonator pad 60A.

Electrode portion 227 is located on top rim 200 of post 110B and connects with electrode portion 226 on post 110B, which is connected with electrode portion or pad 223 that is located on top surface 14. Electrode 220 is surrounded on all sides by unmetallized areas 44.

Input connection area of metallization or electrode 512 is substantially L-shaped and is located toward end 12B. Input connection area or electrode 512 includes electrode portions of arm 513, fingers 514, pad 515, sloped electrode portion 516 and top portion 517. Electrode portion or fingers 514 extend from arm 513 and are interdigitated with respective fingers of resonator pad 60F.

Electrode portion 517 is located on top rim 200 of post 510 and connects with electrode portion 516 on post 510, which is connected with electrode portion or pad 515 that is located on top surface 14. Electrode 512 is surrounded on all sides by unmetallized areas 44.

Thus, in the embodiment shown, the posts 110B and 510 define conductive input/output pads adapted to be seated on appropriate input/output pads formed on a printed circuit board. The posts 110D and 520, however, do not contain electrodes, are not metallized, and are surrounded on all sides by unmetallized areas 44. In other embodiments, posts 110D and 520 may contain additional electrodes that can be part of filter 500. For example, electrodes may be added to posts 110D and 520 in the case where filter 500 is designed as a duplexer or triplexer type filter.

Filter 500 thus has connection posts on both sides 18 and 20 of core 12. The use of connection posts 110B, 110B, 510 and 520 on both sides of core 12 allows for more flexibility in the design and layout of the printed circuit board 300 (FIG. 2) to which filter 500 is mounted.

Numerous variations and modifications of the embodiments described above may be effected without departing from the spirit and scope of the novel features of the invention. It is to be understood that no limitations with respect to the specific filters illustrated herein are intended or should be inferred. It is, of course, intended to cover by the appended claims all such modifications as fall within the scope of the claims.

I claim:

1. A filter comprising:

a core of dielectric material including a top surface with a surface-layer pattern of conductive areas;

a plurality of through-holes extending through the core and defining a plurality of respective openings in the top surface, the surface-layer pattern of conductive areas on the top surface surrounding at least a portion of one or more of the openings in the top surface;

a wall extending outwardly from and surrounding the top surface, the wall including an inner surface, an outer surface, and a top rim, the wall defining a single cavity in the filter and further defining a shield which prevents external electromagnetic fields outside of the single cavity from causing noise and interference; and at least a first conductive input/output electrode defined by a surface-layer conductive area formed on at least the inner surface and the top rim of the wall and in contact with the surface-layer pattern of conductive areas on the top surface of the core.

2. The filter of claim 1, wherein the wall includes a post located between a pair of spaced-apart narrow slots extending between the outer and inner surfaces of the wall, the at least first conductive input/output electrode being defined on the post.

3. The filter of claim 2, wherein the wall includes a second post located between another set of spaced-apart narrow slots extending between the outer and inner surfaces of the wall and a second conductive input/output electrode is defined on the second post.

4. The filter of claim 3, wherein the core includes at least first and second opposed longitudinal side surfaces, the first and second posts both being located on the wall along the first side surface of the core.

5. The filter of claim 3, wherein the core includes at least first and second opposed longitudinal side surfaces, the first and second posts being located on the wall along the first and second opposed longitudinal side surfaces respectively.

6. An electrical signal filter comprising:

a block of dielectric material with a top surface, a bottom surface, side surfaces, and through-holes extending between the top and bottom surfaces;

a wall extending outwardly from the top surface of the block to define a peripheral top rim and a cavity in the filter, the wall extending contiguously around the periphery of the top surface of the block of dielectric material except for narrow slots which extend through the wall and form first and second isolated posts;

a pattern of metallized and unmetallized areas defined on selected surfaces of the block including a pattern of metallized and unmetallized areas defined on the top surface of the block including first and second strips of metallization extending between the top surface of the block and onto the top rim of the wall to define at least first and second input/output electrodes on the wall, the first and second input/output electrodes being formed on said first and second isolated posts and the filter is adapted for mounting to a printed circuit board with the peripheral top rim of the wall seated against the printed circuit board and the first and second input/output electrodes coupled to respective input and output pads on the printed circuit board.

7. A filter comprising:

a core of dielectric material including a top surface with at least a pattern of conductive areas;

a plurality of through-holes extending through the core and defining a plurality of respective openings in the top surface;

a wall extending outwardly from and surrounding the top surface, the wall including an inner surface, an outer surface, and a top rim and defining a single cavity in the filter and wherein at least a portion of the wall includes a sloped inner surface; and at least a first conductive input/output electrode defined by a conductive area formed on at least the sloped inner surface and the top rim of the wall and in contact with the conductive areas on the top surface of the core.

8. A filter comprising:

a block of dielectric material with a top surface, a bottom surface, and at least one side surface, the block defining at least a first through-hole extending between a respective opening defined in the top surface and a corresponding opening defined in the bottom surface;

a plurality of walls extending outwardly from the top surface including at least a first wall with a sloped inner surface;

a pattern of metallized and unmetallized areas defined on the block, including:

a contiguous area of metallization covering at least a portion of the top, bottom and side surfaces, the at least a first through-hole and at least a portion of the plurality of walls;

at least a first resonator pad surrounding the opening of the at least a first through-hole and electrically coupled to the contiguous area of metallization;

an input electrode defined on the top surface and extending onto the sloped inner surface of the at least a first wall;

an output electrode defined on the top surface and extending onto the sloped inner surface of the at least a first wall; and a contiguous unmetallized area substantially surrounding the first resonator pad, the input electrode and the output electrode.

9. The filter of claim 8, wherein the plurality of walls and the top surface together define a cavity in the block.

10. The filter of claim 8, wherein the at least first wall includes at least first and second posts located between respective slots extending through the at least first wall, the input electrode extending onto the first post and the output electrode extending onto the second post.

11. The filter of claim 10, wherein the at least first and second posts each include a sloped inner surface.

12. The filter of claim 10, wherein the first and second posts are defined on different ones of the plurality of walls.

13. A filter comprising:

a core of dielectric material with a top surface, a bottom surface, and at least first, second, third, and fourth side surfaces, said core defining a series of spaced-apart through-holes, each through-hole extending through the core from an opening defined in said top surface to an opening defined in said bottom surface;

a wall of dielectric material extending outwardly from the top surface of the core;

first and second posts located between respective first and second pairs of slots extending through the wall;

a surface-layer pattern of metallized and unmetallized areas on said core, said pattern including:

a wide area of metallization;

at least one pad of metallization formed on said top surface and surrounding at least a portion of one or more of said openings in said top surface;

an input connection area of metallization located on said top surface and extending onto said first post; and an output connection area of metallization located on said top surface and extending onto said second post.

14. The filter of claim 13 wherein both of said first and second posts are located between said respective first and second pairs of slots extending through said wall along the first side surface of the core.

15. The filter of claim 13, wherein each of the first and second posts defines a top rim, the input and output connection areas of metallization extending over the top rim of the first and second posts respectively and the top rim of the first and second posts being adapted to be seated on a printed circuit board.

16. A filter comprising:

a core of dielectric material with a top surface, a bottom surface, and at least first, second, third, and fourth side surfaces, said core defining a series of spaced-apart through-holes, each through-hole extending through the core from an opening defined in said top surface to an opening defined in said bottom surface;

a wall of dielectric material extending outwardly from the top surface of the core;

first and second posts located between respective first and second pairs of slots extending through the wall, the first and second posts each include a sloped inner surface; and a surface-laver pattern of metallized and unmetallized areas on said core, said pattern including:

a wide area of metallization;

at least one pad of metallization formed on said top surface and surrounding at least a portion of one or more of said openings in said top surface;

an input connection area of metallization located on said top surface and extending onto said first post; and an output connection area of metallization located on said top surface and extending onto said second post.

17. A filter comprising:

a core of dielectric material with a top surface, a bottom surface, first and second opposed end side surfaces, and third and fourth opposed side surfaces extending between the first and second opposed end side surfaces, said core defining a series of spaced-apart through-holes, each through-hole extending through the core from an opening defined in said top surface to an opening defined in said bottom surface;

a wall of dielectric material extending outwardly from the top surface of the core;

first and second posts located between respective first and second pairs of slots extending through the wall, said first and second posts being located between said respective first and second pairs of slots extending through said wall along said third and fourth opposed side surfaces respectively in a relationship spaced from the first and second opposed end side surfaces respectively; and a surface-layer pattern of metallized and unmetallized areas on said core, said pattern including:

a wide area of metallization;

at least one pad of metallization formed on said top surface and surrounding at least a portion of one or more of said openings in said top surface;

an input connection area of metallization located on said top surface and extending onto said first post; and an output connection area of metallization located on said top surface and extending onto said second post.

18. An electrical signal filter comprising:

a block of dielectric material with a top surface, a bottom surface, side surfaces, and through-holes extending between respective openings in the top and bottom surfaces of the block;

a wall of dielectric material extending outwardly from the top surface of the block, the wall including an inner surface and a peripheral top rim and defining a cavity in the filter;

a surface-layer pattern of metallized and unmetallized areas defined on selected surfaces of the block of dielectric material including a surface-layer pattern of metallized and unmetallized areas defined on the top surface of the block including first and second continuous surface-layer strips of metallization extending from the top surface of the block onto first and second posts located between respective first and second narrow slots extending through the wall to define at least first and second input/output electrodes.

* * * * *